United States Patent [19]

Mosé et al.

[11] 4,017,376

[45] Apr. 12, 1977

[54] ELECTROLYTIC CELL

[75] Inventors: Luciano Mosé, Dortmund-Hoechsten; Wolfgang Kramer, Herdecke; Wolfgang Strewe, Dortmund; Bernd Strasser, Hamm, all of Germany

[73] Assignee: Hooker Chemicals & Plastics Corporation, Niagara Falls, N.Y.

[22] Filed: Jan. 20, 1975

[21] Appl. No.: 542,537

[30] Foreign Application Priority Data

Oct. 2, 1974 Germany ..... 2448187

[52] U.S. Cl. ..... 204/258; 204/266; 204/283; 204/286; 204/288

[51] Int. Cl.[2] ..... C25B 1/24; C25B 9/02; C25B 9/04

[58] Field of Search ..... 204/266, 242, 263, 258, 204/247, 253, 257, 94, 128, 252, 286

[56] References Cited

UNITED STATES PATENTS

| | | | |
|---|---|---|---|
| 3,342,717 | 9/1967 | LeDuc | 204/266 X |
| 3,498,903 | 3/1970 | Kamarjan | 204/266 |
| 3,677,927 | 7/1972 | Raetzsch et al. | 204/266 X |
| 3,859,196 | 1/1975 | Ruthel et al. | 204/266 X |
| 3,883,415 | 5/1975 | Shibata et al. | 204/286 X |
| 3,891,531 | 6/1975 | Bouy et al. | 204/286 X |

*Primary Examiner*—Arthur C. Prescott
*Attorney, Agent, or Firm*—Peter F. Casella; Herbert W. Mylius

[57] ABSTRACT

A novel electrolytic cell of the vertical electrode type comprising a novel cathode busbar structure, novel cathode elements and a novel anode base structure which enable the novel electrolytic cell to be designed to operate at high current capacities upward to about 500,000 amperes while maintaining high operating efficiencies. These high current capacities provide for high production capacities which result in high production rates for given cell room floor areas and reduce capital investment and operating costs.

29 Claims, 18 Drawing Figures

ELECTROLYTIC CELL

BACKGROUND OF THE INVENTION

This invention relates to electrolytic cells suited for the electrolysis of aqueous solutions. More particularly, this invention relates to electrolytic cells suited for the electrolysis of aqueous alkali metal chloride solutions.

Electrolytic cells have been used extensively for many years for the production of chlorine, chlorates, chlorites, caustic, hydrogen and other related chemicals. Over the years, such cells have been developed to a degree whereby high operating efficiencies have been obtained, based on the electricity expended. Operating efficiencies include current, voltage and power. The most recent developments in electrolytic cells have been in making improvements for increasing the production capacities of the individual cells while maintaining high operating efficiencies. This has been done to a large extent by modifying or redesigning the individual cells and increasing the current capacities at which the individual cells operate. The increased production capacities of the individual cells operating at higher current capacities provide higher production rates for given cell room floor areas and reduce capital investment and operating costs. In general, the most recent developments in electrolytic cells have been towards larger cells which have high production capacities and which are designed to operate at high current capacities while maintaining high operating efficiencies. Within certain operating parameters, the higher the current capacity at which a cell is designed to operate, the higher is the production capacity of the cell. As the designed current capacity of a cell is increased, however, it is important that high operating efficiencies be maintained. Mere enlargement of the component parts of a cell designed to operate at low current capacity will not provide a cell which can be operated at high current capacity and still maintain high operating efficiencies. Numerous design improvements must be incorporated into a high current capacity cell so that high operating efficiencies can be maintained and high production capacity can be provided.

The development in electrolytic cells is demonstrated by Table 1:

| | | | |
|---|---|---|---|
| Amperage kA | 80 | 150 | 200 |
| Number of Anodes per cell | 42 | 75 | 100 |
| Number of rows per cell | 2 | 3 | 4 |
| Anodes per row | 21 | 25 | 25 |
| Approx. cell width (m) | 1.6 | 2.3 | 3.0 |
| Approx. cell length (m) | 1.9 | 2.2 | 2.2 |
| Aspect ratio | 1.2 | 1.0 | 0.7 |
| Amperage kA/m per m cell length | 42 | 68 | 91 |
| chlorine production (tons/day) | 2.4 | 4.5 | 6.0 |

It is known to perform the electrolysis of aqueous solutions on an industrial scale in cells equipped with either horizontal electrodes sloping towards the horizontal plane of the floor, or with vertical electrodes.

This invention describes a novel cell with vertical electrodes. Cells with vertical electrodes are composed of at least one anode and one cathode, preferably, however, of a plurality of anodes and cathodes, the active anode and cathode surfaces being substantially arranged vertically and in parallel to each other. The gap between each anode and cathode surface is filled with the electrolyte.

An important field of application of cells with vertical electrodes is, for example, the electrolytic production of chlorine, caustic soda and hydrogen from alkali metal chlorides. For this field of application, a separator must be provided in the electrolysis space between anode and cathode surfaces. This separator is required to provide little obstruction to the ion transport necessary for the electrolysis while substantially avoiding any mixing of the products formed on the electrode surfaces. Various materials are known to possess the properties required to provide the proposed purpose of the separator for the alkali metal chloride electrolysis process. Use is made, for example, of asbestos as well as of different microporous plastics materials or nonporous ion exchange materials.

A basic requirement for any electrolysis cell is to maintain at a minimum the electrolysis gap, i.e., the space between anode and cathode surface, because energy losses will rise significantly with increased electrode spacing, because of the high electrical resistance of the electrolyte.

In the early prior art, chlor-alkali diaphragm cells were designed to operate at the above mentioned current capacities having the shown production capacities. Inasmuch as the production rate of electrolysis cells is limited, industrial plants comprise a plurality of cells connected in series electrically. Bus-bars made of a material of good electrical conductivity, for example, copper or aluminum, are used for the electrical connection of the cells. The specific load, i.e. current density per unit of cross-sectional area, of these bus-bars is subject to limitation, because physical laws teach that the temperature of an electric conductor is bound to rise as the specific load increases, and also the energy loss through the conductor resistance will increase. As electrolysis cells are operated at high current capacities, the cross-sectional areas of the bus-bars must be sized accordingly. For as an instance at a load of 200 kA, the total cross-sectional area of the bus-bars of each cell connection would have to be about 1,000 sq. cm for copper bus-bars.

Within the electrolysis cell, the electrical connection from the bus-bars to the anode and cathode surfaces is made by an anode and cathode structure, that is also fabricated of materials of good electrical conductivity.

For the reason outlined above, the cross-sectional areas of the anode and cathode structures must also be adapted to the current load of the cell. As the total expense of conductive material results from the product of conductor cross-sectional area and conductor length, while the conductor cross-sectional area for a given cell load is fixed for said reasons, it is another basic requirement for electrolysis cells that the total conductor length of the cell plant be reduced as far as possible for limitation of conductor material expense.

In conventional plants, this is achieved by arranging the cells in a row and reducing the spacing of the cells within a row. Basically, this principle of the shortest current path is characterized by the fact that the reduction of conductor material expense and electrical energy losses requires the reduction of the spacing between centerlines of adjacent electrolysis cells arranged in one row.

One way to reduce the spacing of centerlines of adjacent cells is to hold the free space between adjacent cells at a minimum. This method is common practice in conventional electrolysis plants. The spacing between centerlines of electrolysis cells can also be limited by reducing the cell width, i.e., the extension of the cell in the direction of the cell row as shown in FIG. 1,2,& 3. As a certain definite number of electrode elements must be installed for maintaining the conventional production rate of a cell, while the space occupied by these elements corresponds to the product of cell width and cell length, (cell lengths shall be construed to mean the extension of the cell perpendicular to the direction of the cell row as shown in FIG. 1,2& 3) the cell length must be extended inversely proportional to any reduction of cell width.

The principle of the shortest current path thus leads to the demand to design the electrolysis cells in such a way that the aspect ratio of cell length/cell width be as large as possible.

Cells with horizontal or sloping electrodes do not present any major difficulties to be designed for a large aspect ratio.

Many types of the known mercury cells used for the production of chlorine and NaOH have been designed with an aspect ratio of 8 through 10 or even more.

Referring to the known types of cells with vertical electrodes, however, and particularly referring to the known diaphragm cells for the production of chlorine and NaOH, the cell design is either a square or a relatively wide rectangle with an aspect ratio of approx. 1 to 2.

For cells with vertical electrodes, increasing this aspect ratio to any considerable extent would present basic difficulties.

More anode and cathode elements must be installed alternately in series in a longitudinal direction of the cell as the cell length is increased.

As the same time, the spacing between adjacent anode and cathode elements must be held at a minimum as outlined above.

Because the anode part and the cathode part of a cell are fabricated in separate production process, mostly even in different works, and because each fabrication process is bound to require non-avoidable dimensional tolerances, full dimensional conformity between anode and cathode parts cannot be achieved.

As each individual element of anode and cathode parts is already subject to dimensional tolerances, the total deviation of anode and cathode parts from the theoretical dimension will necessarily increase with the number of electrode elements arranged in series. The increasing deviation from the theoretical dimension of anode and cathode parts at increasing cell length might lead to a considerable difference of the distance between an anode part and an adjacent cathode part during the assembly of both parts. This will in any case adversely affect the electrolysis process; further the spacing might become so small that there is no space left for the separator or that anode and cathode parts will come in contact during assembly.

A further limitation regarding current load and production rate of conventional cells with vertical anodes is caused by the strong magnetic fields in the cell area, which exert considerable forces upon all cell parts made of magnetic material, such as iron, steel, stainless steel, etc. These magnetic forces might seriously disturb the operation of an electrolysis plant. At the time of replacing a cell, for example, the crane is not only loaded with the cell itself, but has also to over come considerable magnetic forces developed from the adjacent cells. Further the cell suspended on the crane would tend to orientation with the gradient of the magnetic field, which would lead to unforeseeable and dangerous movements of the cell. In addition, any parts made of magnetic material, such as screws, bolts, clamps, piping joints, etc., can only be mounted and dismantled on cells subjected to strong magnetic forces after taking adequate safety precautions.

SUMMARY OF THE INVENTION

In accordance with the present invention, there is provided a novel electrolytic cell. The novel electrolytic cell comprises a top, a novel cathode walled enclosure, novel cathode busbar structure, novel cathode elements having a box like structure and a novel anode base structure, including a bottom. The novel cathode walled enclosure comprises four walls which form a rectangular walled enclosure with the length or side walls of the walled enclosure being at least twice as long as the width of the walled enclosure, i.e., having an aspect ratio of the sidewall to the end wall of at least 2:1, of sidewall of the walled enclosure being fabricated from a conductive metal, the conductive metal sidewall having at least one cathode lead-out busbar, said cathode walled enclosure containing a plurality of cathode elements. The novel cathode busbar structure comprises said conductive metal sidewall and said cathode lead-out busbar. This cathode lead-out busbar can be used as a gangway or as a support for it. The novel cathode walled enclosure and the novel cathode busbar structure make the most economic use of invested capital, namely, the amount of conductive metal used in the cathode busbar structure is reduced. The configuration and different relative dimensions of the lead-out busbar or busbars and the plurality of busbar strips significantly reduce the amount of conductive metal required in the cathode busbar or busbars and the plurality of busbar strips by means of their configuration and different relative dimensions are also adapted to carry an electric current and to assure a substantially uniform current density through the cathode busbar structure.

The novel cathode busbar structure can be provided with means for attaching cathode jumper switch means when an adjacent electrolytic cell is jumpered and is removed from the electrical circuit.

The novel cathode elements having a box-like structure which comprises metal means for composite functions of structural supporting or reinforcing and for electrical conducting, said box-like structure comprised of two parallel foraminous plates with their upper and lower ends bent thereby forming the box which is open on both sides after assembly. Said foraminous plates are assembled by being welded to spacer pieces arranged substantially perpendicularly between the foraminous plates and having the shape of straight plates with tooth shape edges on the longitudinal sides, welding being performed by the resistance process, to ensure a uniform nominal distance between the foraminous plates, thereby providing gas compartment space inside the cathode box structure allowing for vertical flow of fluids within said cathode box, the metal means being in electrical contact with the interior of said conductive metal sidewall and being adapted to carry current at a substantially uniform current density through the cathode elements, said cathode walled enclosure containing a plurality of cathode elements which extend substantially across the interior length of the cathode walled enclosure, said conductive metal sidewall comprising a component of the cathode busbar structure.

The cross-sectional area of said spacer pieces may be adapted in the direction of current flow to the increasing current density, and are in electrical contact to said conductive metal sidewall having at least one cathode lead-out busbar.

The novel anode base structure comprises a support base which is used as cell bottom, having holes disposed therethrough for the receipt of anode posts, a corrosion resistant layer covering the support base and having holes disposed therethrough corresponding to the holes in the support base, said layer being adapted to receive a compressible seal between the anode posts and the layer, metal anodes being mounted through said holes, said metal anodes comprising anode blades having electrically conductive coatings deposited on valve metal substrate, said anode blades being mounted on said anode posts thereby forming said metal anodes, the anode posts containing a collar to provide a compressible seal between the anode post and the support base and vertical positioning of said anodes, the portions of the anode posts located below the collars extending through the support base, the anode posts being secured to the support base and being electrically insulated from the support base so that no electric current flows from the anode posts into the support base, the anode posts under the support base being individually connected electrically to anode busbars which are connected to the lead-out cathode busbar of the adjacent cell. The cathode walled enclosure of the electrolytic cell contains a peripheral channel for conducting gases.

The length or sidewall of the walled enclosure is at least two times as long as the width or endwalls.

The conductive metal sidewall of the electrolytic cell is made of copper.

For a better electric current flow, the conductive metal sidewall and the lead-out busbar are made of copper.

In a different design, the conductive sidewall is made of composite metal. The composite metal can be made of copper and steel or aluminium and steel.

The metal means of the cathode elements for structural supporting reinforcing and electrical conducting are composite metals.

To obtain a good contact, the composite metal structure is produced by explosion welding.

In order to obtain good contact between the tooth-shaped edges of the cathode elements and the foraminous plates and to avoid blocking the holes in the foraminous plates, it is preferable to have a pitch that is different from the pitch of the holes and a rectangular cross section with one side longer and the other side shorter than the hole diameter of the foraminous plates. Said spacer pieces are connected to the current collectors in the usual way. Those current collectors shall be smaller than the inside diameter of the cathode elements. The cross-section of the current collectors increases towards the conductive metal sidewall.

To simplify assembly of the cell, the support base holes are sized to receive the anode posts to allow for individual alignment of each anode in relation to its corresponding cathode space.

For the purpose of uniform alignment, the alignment of the metal anodes is maintained by one or more spacing strips mounted on the top of the anodes. The spacing strip mounted on the top of the anodes is a valve metal.

The features of the newly invented cells as described before offer the advantage to eliminate substantial limitations that apply to conventional cells with vertical electrodes. While the length of conventional electrolytic cells is restricted to 2 to 3 m, the newly invented cell can be designed for lengths of 3 to 8 m and over without adversely affecting the electrolysis process. Consequently, the newly invented cell may be equipped with a considerably higher number of anode and cathode elements and can, therefore, be operated at substantially higher amperages and production rates. The following comparison for the design of the newly invented cell as regards the number and arrangement of anode elements as opposed to a conventional type of cell for alkali metal chloride electrolysis.

Table 2

| | Conventional Hooker Cell | | | Novel Cell | | | |
|---|---|---|---|---|---|---|---|
| amperage kA | 80 | 150 | 200 | 100 | 200 | 300 | 400 |
| number of anodes | 42 | 75 | 100 | 50 | 100 | 150 | 200 |
| number of rows | 2 | 3 | 4 | 1 | 2 | 2 | 2 |
| anodes/row | 21 | 25 | 25 | 50 | 50 | 75 | 100 |
| approx. cell width (m) | 1.6 | 2.3 | 3.0 | 0.9 | 1.6 | 1.6 | 1.6 |
| approx. cell length (m) | 1.9 | 2.2 | 2.2 | 4.2 | 4.2 | 6.2 | 8.2 |
| aspect ratio | 1.2 | 1.0 | 0.7 | 4.7 | 2.6 | 3.9 | 5.1 |
| spec. amperage (kA/m cell length) | 42 | 68 | 91 | 24 | 48 | 48 | 49 |
| chlorine production (tons/day) | 2.4 | 4.5 | 6.0 | 3.0 | 6.0 | 9.0 | 12.0 |

The comparison shows that the new cell can be designed for amperages up to 400 kA and more and chlorine production rates up to 12 tons per day by enlarging the cell length up to approx. 8.2 m, whereas conventional cells of a limited cell length of approx. 2.2 m max. are rated at 200 kA and 6 tons per day of chlorine. From the physical law it is known that the magnetic forces developed by a certain definite amperage will increase in proportion to the concentration of electric current along the axis of the main flux direction, i.e., in this case along the direction of the cell row. Due to limitation of the cell length in conventional electrolysis cells, the flow concentration along each cell row axis is considerably higher compared to the cell of the present invention. This concentration can be numerically expressed by the flux transported per m of cell length. Table 2 shows that this flux concentration in the new cell does not reach 50 kA/m, even in case of a cell load of 400 kA, whereas in conventional cells, a concentration of approx. 90 kA/m is reached at as low a cell load as 200 kA. The new cell type thus distinguishes itself by the fact that the disturbing influence of magnetic forces, even in case of extreme amperages, is considerably less serious than in conventional vertical electrode cells operating at lower amperages. The cell according to the present invention thus contributes to improving the operational safety at the time of maintenance and erection work within the cell plant. The novel electrolytic cell of the present invention may be used in many different electrolytic processes. The electrolysis of aqueous alkali metal chloride solutions is of primary importance and the electrolytic cell of the present invention will be described more particularly with respect to this type of process. However, such description is not intended to be understood as limiting the usefulness of the electrolytic cell of the present invention or any of the claims covering the electrolytic cell of the present invention.

DESCRIPTION OF THE DRAWINGS

The present invention will be more fully described by reference to the drawings in which:

FIG. 13 shows a group of cathode elements forming the corresponding anode spaces between;

FIGS. 1 through 3 show as schematics layouts of the top view of a three anode rows cell, two anode rows and a single anode row cell, respectively, the cells having the same number of anodes 1 and being designed for the same current load and production capacity. The arrows 2 represent one unit of electric current. The comparison illustrates that current concentration drops and the current path becomes shorter as the cell length increases. The comparison referring to a two-row and three-row cell, respectively, designed for a current load of, for example 200 kA, will also be noted from Table 2.

Referring to FIG. 4, the electric current passes through anode busbar 3, anode post 4 to anode blades 5. The anode posts are fixed in and insulated electrically from support base 6. The support base serves as cell bottom and is covered with a corrosion-protecting layer 7.

FIG. 5 shows the electric current passes from anode blades 5 across the electrolyte through a separator as shown in 8*c* in FIG. 5—into the foraminous plates 8 of the cathode element. From these plates, the current flow continues through spacer pieces 9 and current collectors 10 to the conductive metal sidewall 11 whose lower part terminates in the cathode lead-out busbar 12. Cathode elements 17 are supported through spacer pieces 9 on sidewall 26.

FIG. 6 shows the cell assembly consisting of the elements of FIGS. 4 and 5 and of the cell top 13 with its gasket 14. The figure also shows the current connection to the adjacent cells and gasket 15 inserted between cell bottom and cathode walled enclosure.

Anode busbars 3 comprise in whole or in part of flexible conductors. This design permits the anode busbars bolted to the anode posts to follow the movement of the anode posts at the time of fixing or retightening the anodes by means of nut 38.

Figure 6:
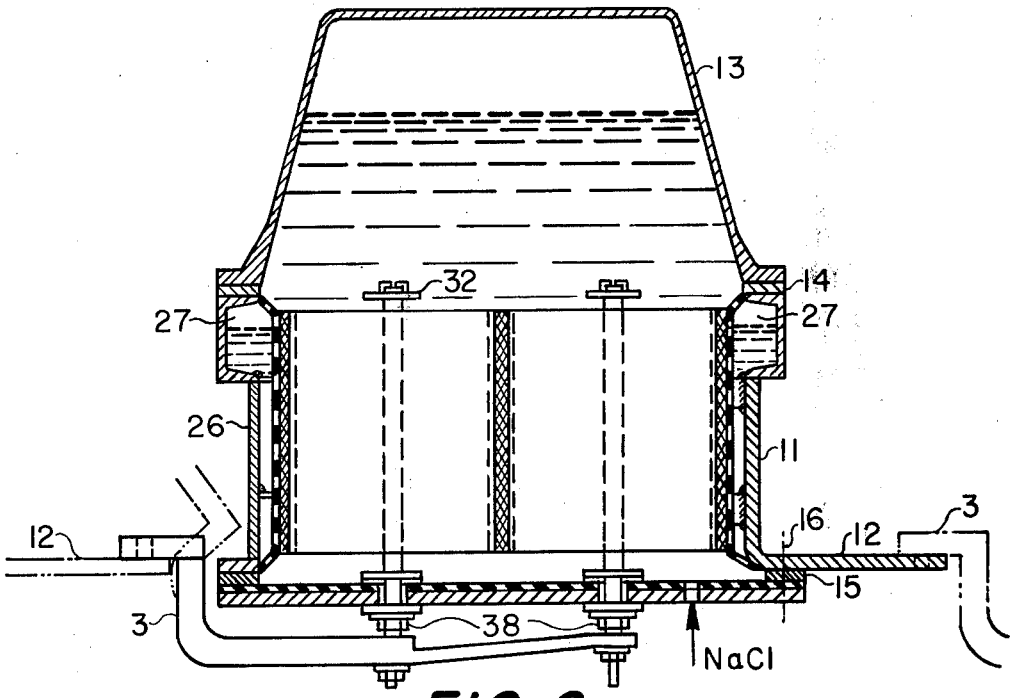
FIG. 6 shows a cross-sectional view of the assembled cell, including anode part, cathode part, and cell cover.

In addition, making and breaking the electrical connection to and from the adjacent cells is significantly facilitated in that the anode busbar ends (shown in dotted lines in FIG. 6) can be turned up. Moreover, the flexibility prevents the building-up of mechanical stresses between anode busbars and anode posts that might be caused, for example, by different thermal expansion of anode base and anode busbars. The flexibility also ensures compensating assembly tolerances with respect to adjacent cells, thus facilitating the installation of the electrical connections and the replacement of a cell within a cell row.

The bottom is fixed to the cathode walled enclosure by means of insulating bolting 16 to prevent any flow of electric current from the cathode part to the anode part.

The insulating bolting 16 of anode support 6 prevents the formation of current leakage between anode part and cathode part. Conventional cells that do not feature this double insulation cannot be protected in this perfect way against the risk of current leakage formation. It is known that current leakage is liable to cause both electro-chemical corrosion and electric power losses.

Figure 7:
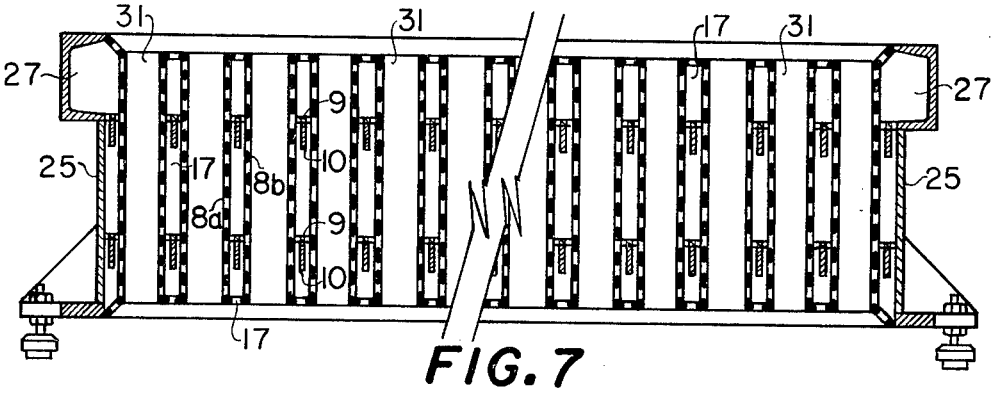
FIG. 7 shows a longitudinal cross-section of the cathode part of the cell.

FIG. 7 shows a longitudinal cross-section of the cathode part of the cell with the plurality of cathode elements 17.

Figure 8:
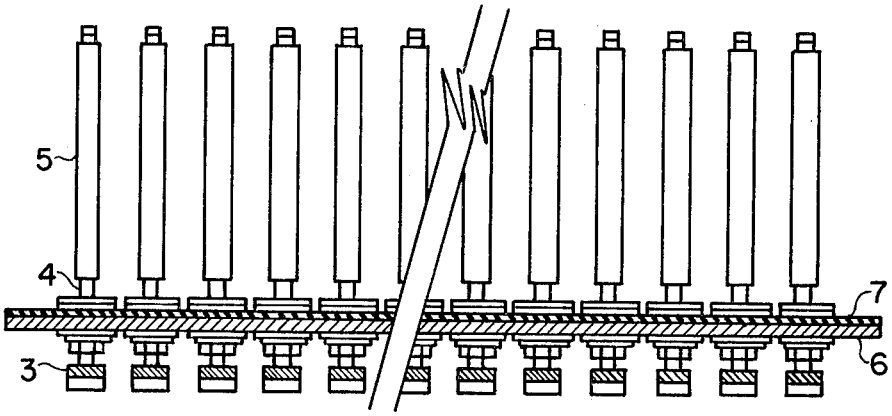
FIG. 8 shows a longitudinal cross-section of the anode part of the cell.

FIG. 8 shows a longitudinal cross-section of the anode part with the plurality of anodes 5 and the anode busbars 3.

Figure 9:
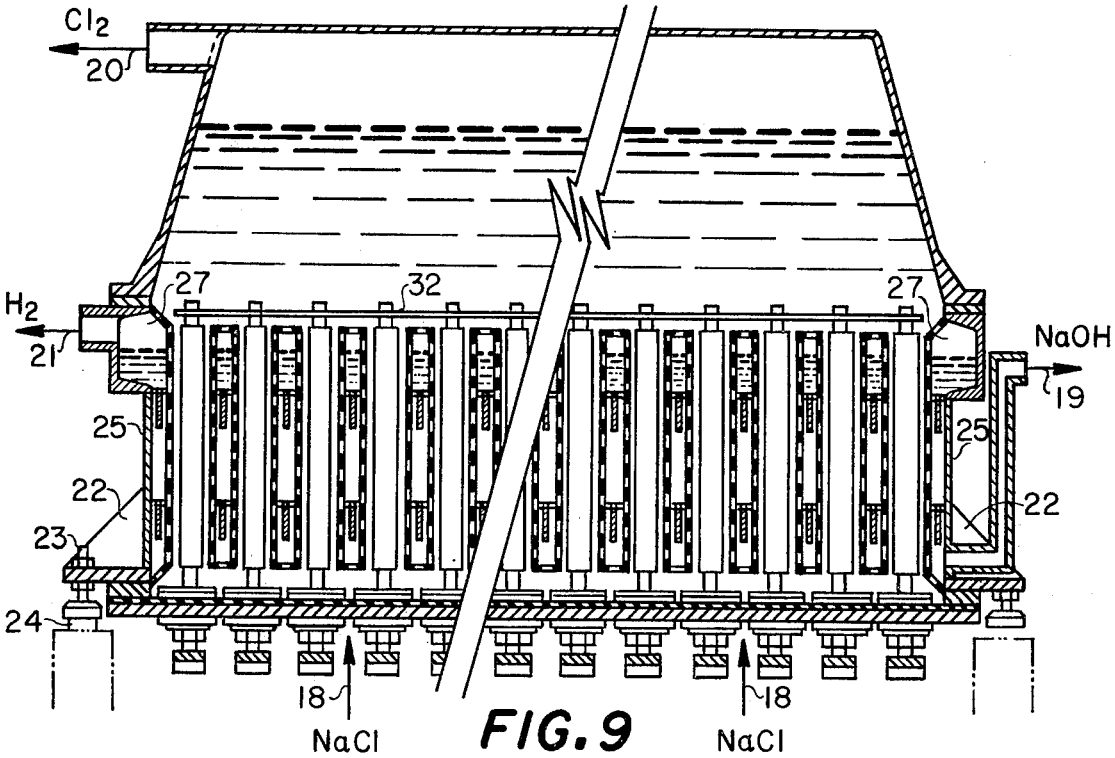
FIG. 9 shows a longitudinal cross-section of the assembled cell, including anode part, cathode part, and cell cover.

FIG. 9 is a longitudinal cross-section of the cell assembly and shows the parts of FIGS. 7 and 8, the top of the cell, and the connections for anolyte 18, catholyte 19, anode gas 20 and cathode gas 21. The cathode gas evolved in the cathode element is collected in peripheral chamber 27.

The cathode part of the cell is provided with usual support means 22, adjusting screw 23 and insulator 24. The support means 22 are fixed to the two end walls 25. Consequently, the cathode walled enclosure is designed for transferring the total operating weight of the cell.

Figure 1:
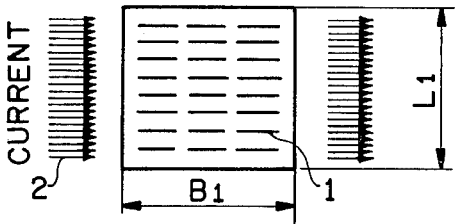
FIG. 1 shows a three-row cell layout.
Figure 2:
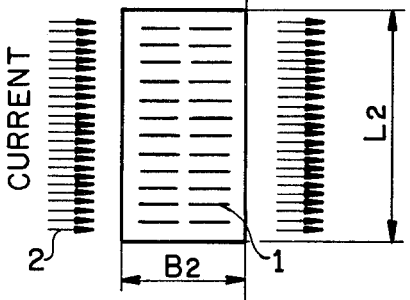
FIG. 2 shows a two-row cell layout.
Figure 3:
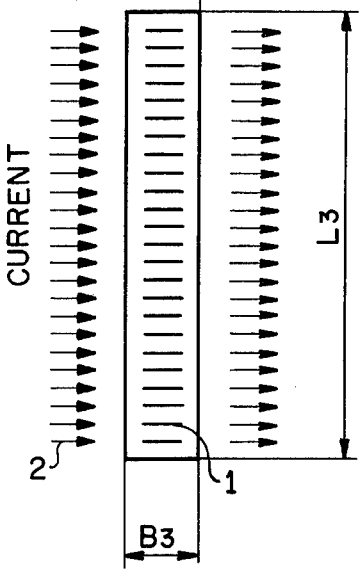
FIG. 3 shows a single-row cell layout.
Figure 5:
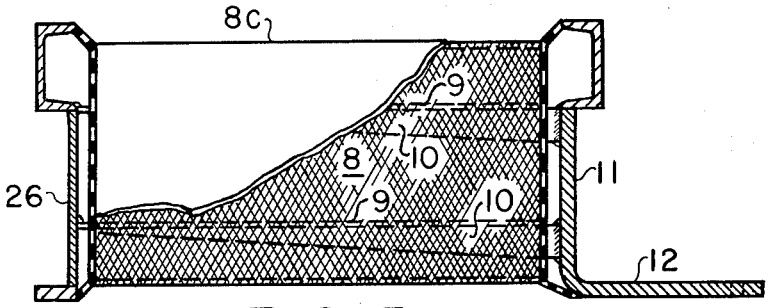
FIG. 5 shows a cross-sectional view of the cathode part.
Figure 4:
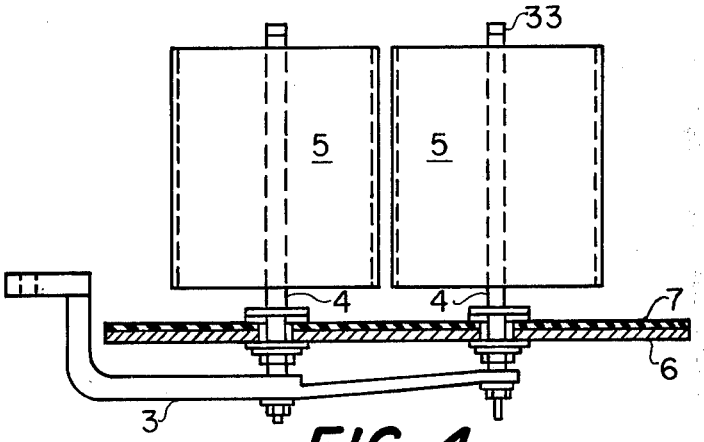
FIG. 4 shows a cross-sectional view of the anode part.

The two endwalls 25 and sidewall 26 with the conductive metal sidewall of FIG. 5 combined form the rectangular walled enclosure of the cathode part. It is only the conductive metal sidewall 11 that must necessarily be made from a conductive metal. The conductive metal should have adequate electrical conductivity and should be adequately protected against corrosion.

The three other walls are not required to have current-conducting properties. They may also be of any suitable non-conducting material.

Figure 10:
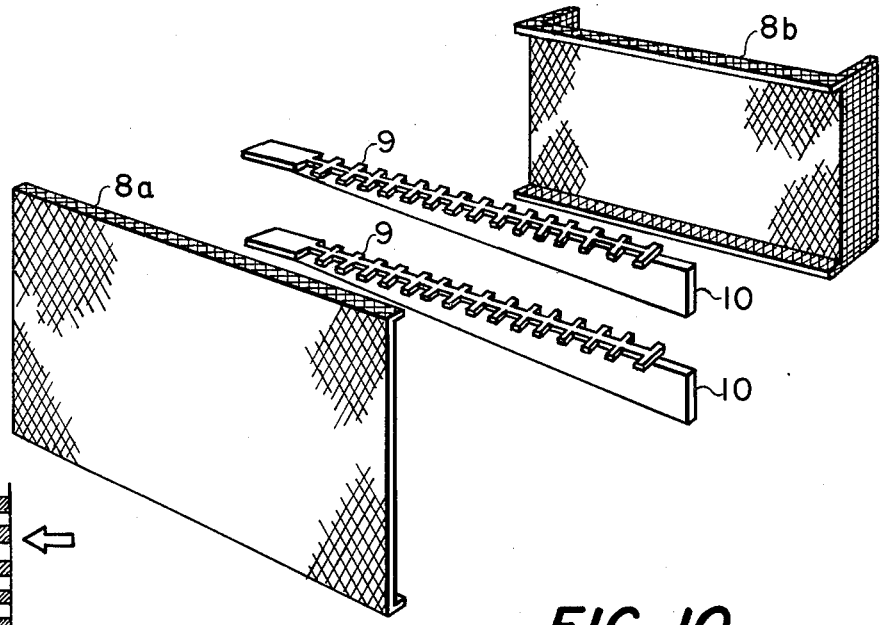
FIG. 10 shows the individual parts of the cathode element.

FIG. 10 shows the various parts of the cathode element. They comprise the foraminous plates 8*a* and 8*b*, the spacer pieces 9 between said plates and the current collectors 10 connected to said pieces.

Figure 11:
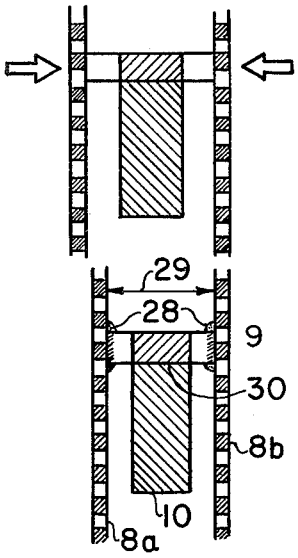
FIG. 11 shows detail of welding of cathode elements.

FIG. 11 shows a detailed view of connecting point 28 between spacer piece and foraminous plates, said point being fabricated according to the present invention through resistance welding the application of mechanical pressure to obtain the theoretical dimension 29.

The shape of the teeth of the spacer pieces is adapted to said resistance welding procedure. In addition, the special design of these teeth ensures a good current transition from the foraminous plates to the spacer pieces while the numerous gaps separating the teeth permit an unobstructed flow of the caustic soda solution and of the hydrogen that are formed in the cathode elements so that the hydrogen may freely ascend into peripheral chamber 27 while the caustic soda solution may pass to and collect along the cell sides.

The teeth have preferably a rectangular cross-sectional area with one side of the rectangle being longer than the aperture diameter of the foraminous plates while the other side of the rectangle is shorter than said diameter.

Preference is given to a teeth pitch which is different from that of the apertures of the foraminous plates. This preferred configuration of the teeth offers the advantage that apertures cannot fully be covered by the teeth ends at the time when the spacer pieces are welded in place and that not all of the teeth of any one distance piece can coincide with all of the apertures of any one row of apertures.

If the spacer pieces are designed along the principles outlined above, perfect automatic welding can be performed without impairing the purpose of the apertures as discharge ports for caustic soda solution and hydrogen.

The unique configuration of the spacer pieces combined with the automatic welding of these pieces to the foraminous plates permits extremely precise fabrication of the cathode elements and is, therefore, an essential feature of the newly invented cell.

FIG. No. 11 also shows connection 30 between the spacer piece and the current collector, said connection, for instance, being made by explosion welding according to the present invention.

Figure 13:
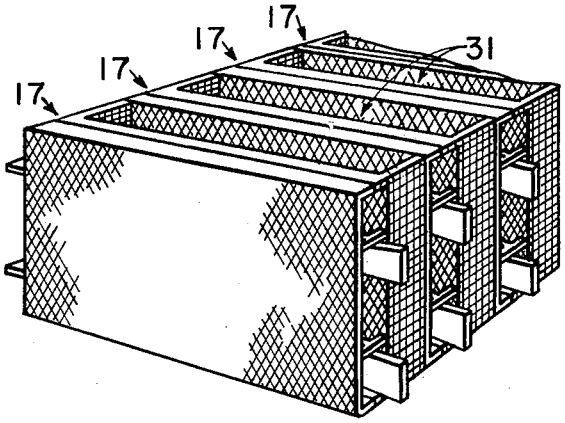
Figure 12:
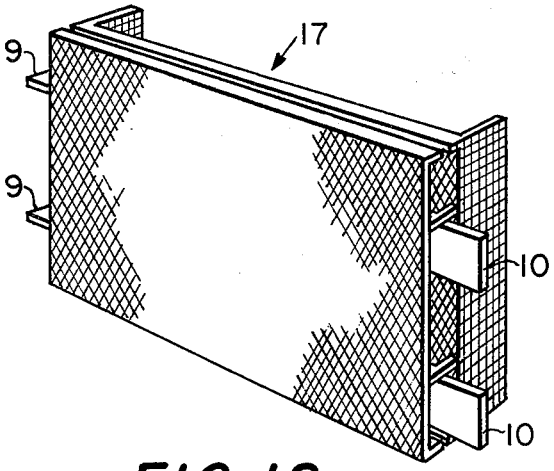
FIG. 12 shows assembled cathode element.

The assembly of the entire cathode element is shown in FIG. 12 while FIG. 13 shows the assembly of a plurality of cathode elements. This assembly shows the formation of the anode chambers 31 between the cathode elements, said chambers being consequently formed through the special design of the two foraminous plates of the cathode elements.

Figure 14:
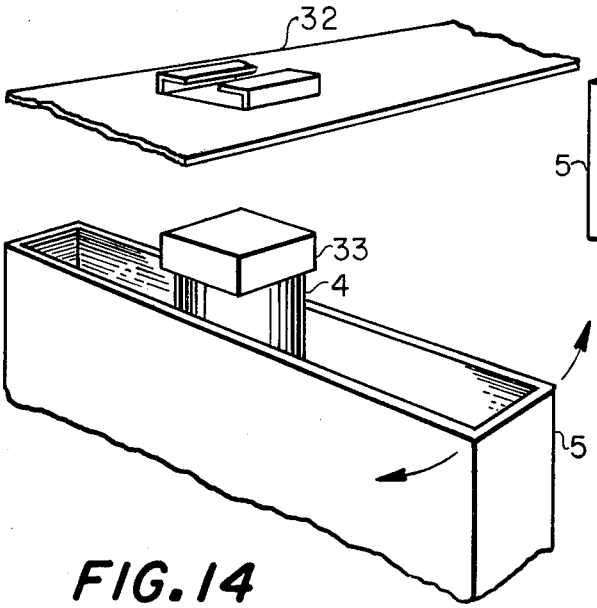
FIGS. 14 and 15 show a spacing strip and the top of an anode with a corresponding end plug.
Figure 15:
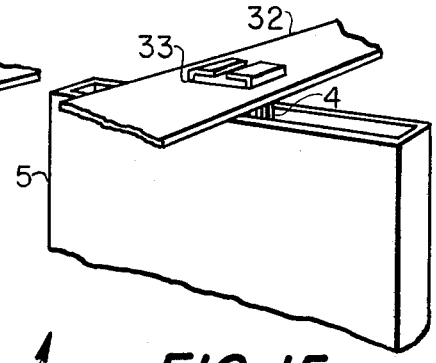

FIGS. 14 and 15 show the spacing strip 32 for the alignment of anodes and the end plug 33 for the connection of items 32 and 33.

Figure 16:
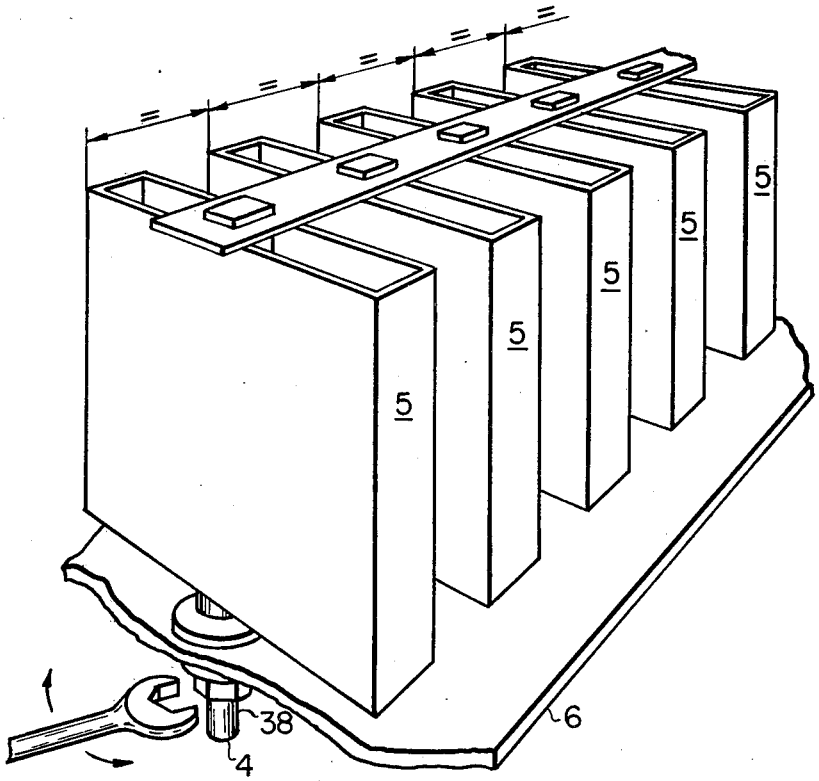
FIG. 16 shows a group of anodes with the spacing strip and the method of assembly.

The advantage of the design according to the present invention with respect to the individual alignment of anodes is illustrated in FIG. 16. All anodes of one row are necessarily aligned in parallel and held in place by spacing strip 32.

At the time of final tightening of the anode nut 38, the spacing strips prevent any displacement of the anodes so that assembly operations are substantially facilitated. The anode nuts 38 may be retightened even during operation of the cell. Retightening will be necessary whenever the efficiency of the gaskets has deteriorated through natural ageing. Elimination of leakages on the anode assemblies of conventional cells requires the cell to be shut down and opened so that a counteracting force may be applied from inside the cell to the anode concerned by means of a wrench or similar device for retightening the anode nut and the correct position of the anode checked after retightening.

Referring to vertical-electrode electrolytic cells, the means for fixing the anode elements as provided for by the present invention constitutes an improvement with respect to the precise alignment of the anode elements, the assembly of the cell, the continuous cell operation, and the expense for maintenance.

The spacing strips must be fabricated from a material of high mechanical strength because they are required to withstand considerably forces when the anode elements are tightened. The material must also be corrosion-resistant with respect to the products that are present in the anolyte space. In general, this requirement will be satisfied by any material that is suitable for the anode element structure, which means for alkali metal chloride electrolysis cells by valve metals, for example, such as titanium, tantalum or niobium.

Figure 17:
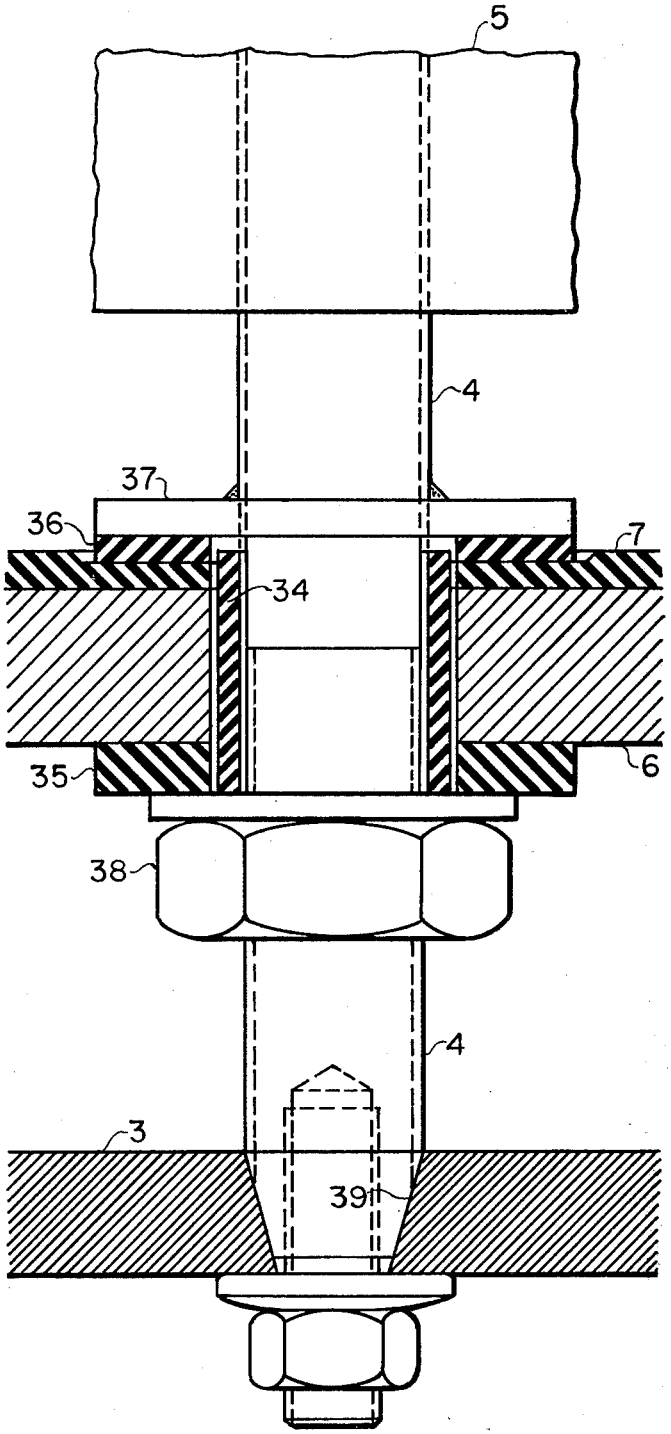
FIG. 17 illustrates a possibility for fixing the anodes to the cell bottom and busbar strips.

FIG. 17 shows the attachment of the anode post 4 on the anode support 6 and on the anode busbars 3 with electrical insulation 34 and 35. The exact vertical alignment of the anodes and the holding down of gasket 36 is secured by the liberally sized collar 37 that is forced against layer 7 by nut 38. This design permits re-tightening the gasket. The electrical connection between anode post and anode busbar is achieved with the aid of cone 39 according to the present invention. This contact has proved to be particularly reliable.

Figure 18:
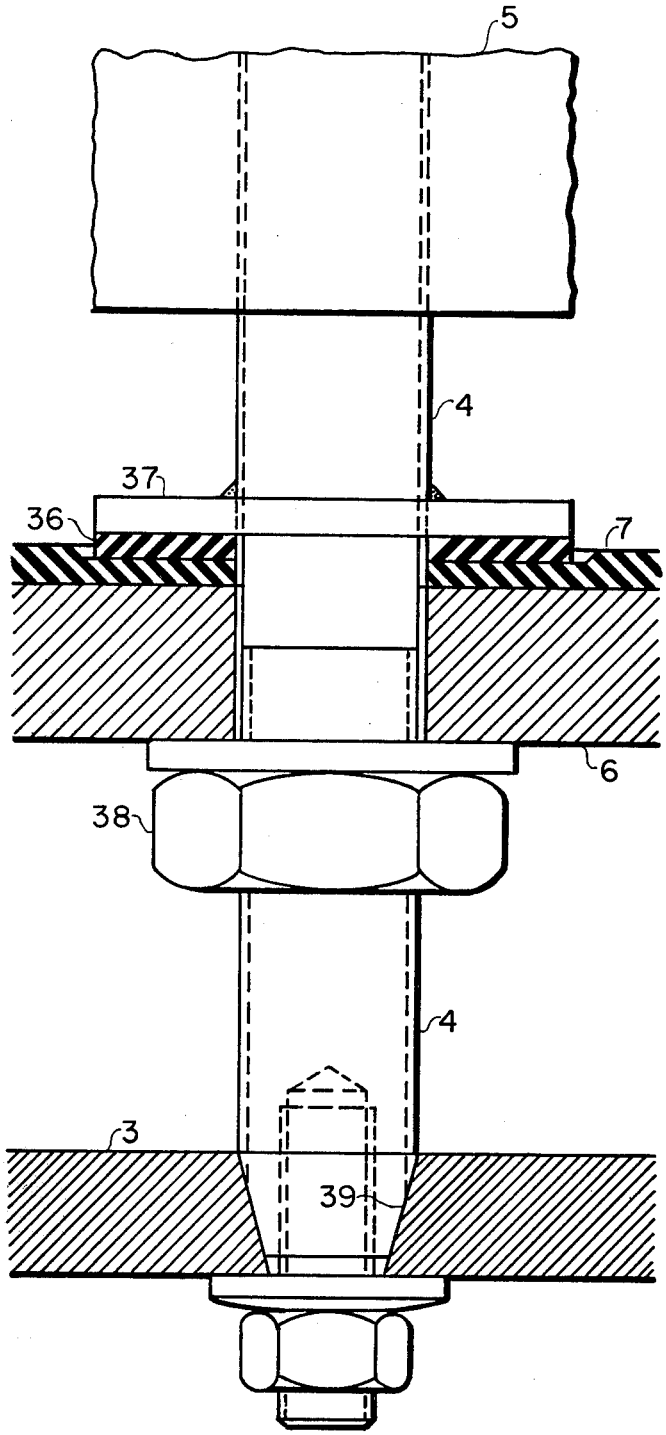
FIG. 18 illustrates another possibility for fixing the anodes to the cell bottom and busbar strips.

FIG. 18 shows another possibility of the attachment of the anode post 4 on the anode support 6 and on the anode busbars 3 without special electrical insulation means between the anode post and the anode support.

The novel electrolytic cell of the present invention can have many other uses. For example, alkali metal chlorates can be produced using the electrolytic cell of the present invention by further reacting the formed caustic and chlorine outside of the cell. In this instance, solutions containing both alkali metal chlorate and alkali metal chloride can be recirculated to the electrolytic cell for further electrolysis. The electrolytic cell can be utilized for the electrolysis of hydrochloric acid by electrolyzing hydrochloric acid alone or in combination with an alkali metal chloride. Thus, the novel electrolytic cell of the present invention is highly useful in these and many other aqueous processes.

While there have been described various embodiments of the present invention, the apparatus described is not intended to be understood as limiting the scope of the present invention. It is realized that changes therein are possible. It is further intended that each component recited in any of the following claims is to be understood as referring to all equivalent components for accomplishing the same results in substantially the same or an equivalent manner. The following claims are intended to cover the present invention broadly in whatever form the principles thereof may be utilized.

We claim:

1. An electrolytic cell of the vertical electrode type including a top and bottom, which cell comprises at least one anode and at least one cathode, a rectangular cathode walled enclosure, a cathode busbar structure, cathode elements having a box-like structure, anode busbars and an anode base structure including a bottom, wherein:

said cathode wall enclosure comprises four walls with the aspect ratio of the sidewalls to the end walls being at least 2:1, one sidewall of the walled enclosure being fabricated from a conductive metal, the conductive metal sidewall having at least one cathode lead-out busbar, said cathode walled enclosure containing a plurality of cathode elements and a peripheral chamber for conducting gases on the upper part of the cathode walled enclosure;

said cathode busbar structure comprises said conductive metal sidewall and said cathode lead-out busbar;

said cathode elements comprise metal means for composite functions of structural supporting and for electrical conducting, said box-like structure comprising two parallel foraminous plates with their upper ends and lower ends bent, thereby forming a box which is open on both sides after assembly;

said metal means comprise spacer pieces attached to the foraminous plates to provide a uniform nominal distance between the foraminous plates, thereby providing gas compartment space inside the cathode box structure allowing for vertical flow of fluids within said cathode box, the metal means being in electrical contact with the interior of said conductive metal sidewall and being adapted to carry current at a substantially uniform current density through the cathode elements, said cathode walled enclosure containing a plurality of cathode elements which extend substantially across the interior length of the cathode walled enclosure, said conductive metal sidewall comprising a component of the cathode busbar structure;

said anode base structure comprises a support base having holes disposed therethrough for the receipt of anode posts, a corrosion resistant and electrically non-conductive layer being located so as to cover the support base and having holes disposed therethrough corresponding to the holes in the support base, said anode posts being in electrical communication with said anode busbars by means of electrical contacts.

2. The electrolytic cell of claim 1, wherein a resistance weld is present between the spacer pieces and the foraminous plate.

3. Electrolytic cell of claim 1 wherein the anode posts being secured to the support base are electrically insulated from the support base.

4. The electrolytic cell of claim 1 wherein the anode posts are individually connected to anode busbars which are connected to the cathode lead-out busbar of the adjacent cell.

5. The electrolytic cell of claim 1 wherein the anode posts are equipped with a collar for inserting a compressible seal between the anode posts and the electrically non-conductive layer of the support base and vertical positioning of said anode.

6. Electrolytic cell of claim 1, wherein the aspect ratio of the sidewalls to the end walls is at least 3 to 1.

7. The electrolytic cell of claim 1, wherein the aspect ratio of the sidewalls to the end walls is at least 4 to 1.

8. The electrolytic cell of claim 1, wherein the aspect ratio of the sidewalls to the end walls is at least 8 to 1.

9. The electrolytic cell of claim 1, wherein the number of cathode elements is at least 50.

10. The electrolytic cell of claim 1, wherein the width of the end walls is at least 0.8 m and the length of the sidewalls is at least 4 m.

11. The electrolytic cell of claim 1, wherein the conductive metal sidewall is made of copper.

12. The electrolytic cell of claim 1, wherein the conductive metal sidewall and the lead-out busbar are made of one piece of metal.

13. The electrolytic cell of claim 12, wherein said one piece of metal is made of copper.

14. The electrolytic cell of claim 1, wherein the cathode lead-out busbar is a walkway between the cells.

15. The electrolytic cell of claim 1, wherein the metal means for structural supporting or reinforcing and electrical conducting are composite metals.

16. The electrolytic cell of claim 15, wherein the composite metal structure is made of copper and steel.

17. The electrolytic cell of claim 15, wherein explosion welds connect components of the composite metal means for structural supporting or reinforcing and electrical conducting.

18. The electrolytic cell of claim 15, wherein the metal means have an increasing cross-sectional area towards the conductive sidewall.

19. The electrolytic cell of claim 1, wherein said spacer pieces have tooth shaped edges on the longitudinal sides of said spacer pieces.

20. The electrolytic cell of claim 19, wherein the teeth of said tooth shaped edges have a pitch that is different from the pitch of the holes in the foraminous plates.

21. The electrolytic cell of claim 19, wherein the cross-section of the teeth of said tooth shaped edges is preferably rectangular, with one side of the rectangle being longer, the other side being shorter, than the hole diameter of the foraminous plates.

22. The electrolytic cell of claim 1, wherein the support base holes are sized to receive the anode posts to allow for individual alignment of each anode in order to ensure a uniform nominal distance between the foraminous plates.

23. The electrolytic cell of claim 1, wherein the anode busbars comprise, in whole or in part, flexible conductors.

24. The electrolytic cell of claim 1, wherein the electrical contacts between the anode posts and anode busbars are secured by conical parts.

25. The electrolytic cell of claim 1, wherein the alignment of the anode or anodes is maintained by one or more spacing strips mounted on the top of the anode or anodes.

26. The electrolytic cell of claim 25, wherein the spacing strip mounted on the top of the anode is a valve metal.

27. The electrolytic cell of claim 1, wherein said cell operates at current capacities of from about 100,000 amp. to about 500,000 amp.

28. The electrolytic cell of claim 1, wherein the anode is separated from the cathode by a separator.

29. The electrolytic cell of claim 1, wherein said cell operates at current capacities of from about 100,000 amp. to about 200,000 amp.

* * * * *